US006077414A

United States Patent [19]

Pütter et al.

[11] Patent Number: 6,077,414

[45] Date of Patent: Jun. 20, 2000

[54] ELECTROLYTIC PLATE STACK CELL

[75] Inventors: Hermann Pütter, Neustadt; Heinz Hannebaum, Ludwigshafen, both of Germany

[73] Assignee: BASF Aktiengesellschaft, Ludwigshafen, Germany

[21] Appl. No.: 09/029,824

[22] PCT Filed: Sep. 10, 1996

[86] PCT No.: PCT/EP96/03970

§ 371 Date: May 11, 1998

§ 102(e) Date: May 11, 1998

[87] PCT Pub. No.: WO97/10370

PCT Pub. Date: Mar. 20, 1997

[30] Foreign Application Priority Data

Sep. 12, 1995 [DE] Germany ..... 195 33 773

[51] Int. Cl.[7] ..... C25B 3/00; C25B 9/00; C25B 11/12; C25B 13/00

[52] U.S. Cl. ..... 205/334; 204/253; 204/267; 204/294

[58] Field of Search ..... 204/267, 294, 204/253–256; 205/334

[56] References Cited

U.S. PATENT DOCUMENTS

| | | | |
|---|---|---|---|
| 3,654,120 | 4/1972 | Messmer . | |
| 4,406,768 | 9/1983 | King | 204/268 |
| 4,459,195 | 7/1984 | Bertaud | 204/268 |
| 4,500,403 | 2/1985 | King | 204/255 |
| 4,894,355 | 1/1990 | Takeuchi et al. | 502/101 |
| 5,162,172 | 11/1992 | Kaun | 429/155 |
| 5,366,824 | 11/1994 | Nozaki et al. | 429/34 |

FOREIGN PATENT DOCUMENTS

| | | |
|---|---|---|
| 629 015 | 12/1994 | European Pat. Off. . |
| 1 917 438 | 11/1969 | Germany . |
| 1 268 182 | 3/1972 | United Kingdom . |

OTHER PUBLICATIONS

Experiences With an Undivided Cell, Weinsch et al., Am. Ins. Of Chem. Eng. 1979 (No Month).

Comparison of Conventional and Electro–Organic Processes, Nohe, Am. Ins. Of chem. Eng., 1979 (No Month).

Derwent Abst. JP860193984, (No Date).

Ind. Electrochemistry, Second Ed. Pletcher et al.18–25, 108–112 (No Date).

*Primary Examiner*—Donald R. Valentine
*Attorney, Agent, or Firm*—Keil & Weinkauf

[57] ABSTRACT

A stacked plate cell having serially connected stacked electrodes is described, at least one stacked electrode consisting of a graphite felt plate, a carbon felt plate, a web having a carbon-covered starting material contact surface or a porous solid having a carbon-covered starting material contact surface or comprising such a material.

17 Claims, No Drawings

ELECTROLYTIC PLATE STACK CELL

The present invention relates to a novel stacked plate cell and to a process for the electrolysis of substances.

Electrolysis cells are employed in modem chemistry in a variety of forms for a multiplicity of tasks. An overview on the construction possibilit ies of electrolysis cells is found, for example, in D. Pletcher, F. Walsh, Industrial Electrochemistry, 2nd Edition, 1990, London, pp. 60ff.

A frequently used form of electrolysis cells is the stacked plate cell. A simple arrangement thereof is the capillary gap cell. The electrodes and corresponding separating elements are frequently arranged here like a filter press. In this type of cell, several electrode plates are arranged parallel to one another and separated by separating media such as spacers or diaphragms. The intermediate spaces are filled with one or more electrolyte phases. An undivided cell usually comprises only one electrolyte phase; a divided cell has two or more such phases. As a rule, the phases adjacent to the electrodes are liquid. However, solid electrolytes such as ion exchange membranes can also be employed as electrolyte phases. If the electrode in this case is directly applied to the ion exchange membrane, e.g. in the form of an electrocatalytic and finely porous layer, additional contacts are necessary which, on the one hand, must be designed as current collectors and, on the other hand, as substance transport promoters. The individual electrodes can be connected in parallel (monopolar) or serially (bipolar). In the context of the invention, cells having bipolar connection of the stacked electrodes are exclusively considered.

In order to achieve as high a substance conversion as possible in electrolysis cells, according to general knowledge the electrolyte should be passed over the electrodes in such a way that optimum substance transport is achieved. In the case of liquid electrolytes, it is frequently proposed to allow the electrolyte liquid to flow parallel to the electrodes.

The space-time yield and the selectivity of the electrolysis also depend, in addition to the flow over the electrodes, on the electrode materials used. These affect the service life, size and weight of the cell considerably.

In known stacked plate cells, the electrodes are as a rule designed as solid plates, for example graphite disks. Electrodes of this type have various disadvantages which result from the solidity of the material, for example the decreased surface area compared with a porous material and the decreased substance conversion, higher weight and greater space requirement accompanying it.

It is thus an object of the present invention to provide a stacked plate cell having increased space-time yield, high selectivity, low weight and space requirement, which is as simple as possible to produce and to operate. A further object of the invention is the provision of electrolysis processes having a high space-time yield and a high selectivity.

We have found that these objects are achieved by the stacked plate cell described in the claims and the processes described.

In the context of the invention, a stacked plate cell having serially (bipolar) connected stacked electrodes is provided, at least one stacked electrode consisting of a graphite felt plate, a carbon felt plate, a web having a carbon-covered starting material contact surface or a porous solid having a carbon-covered starting material contact surface or comprising such a material.

Felts suitable for use in the context of the present invention are commercially available. Both graphite felts and carbon felts can be employed here, both types of felt differing, especially, by the structure of the carbon. Instead of or in addition to the felts described, other porous materials can also be used whose contact surfaces with the starting material are completely or largely covered with carbon. Contact surfaces are in this case those external and internal surfaces with which the starting material to be electrolyzed comes into contact during the electrolysis reaction. These materials can in this case consist completely of carbon, for example carbon web, carbon gauzes or porous carbon solids. However, supports made of other materials can also be used whose contact surface with the starting material is completely or mainly covered with carbon.

The electrode can be made entirely from the materials mentioned or have one or more further layers. These layers can be used, for example, to stabilize the arrangement.

Preferably, the stacked plate cell, in particular the electrodes themselves and the electrolyte, is designed such that as few as possible, in the ideal case no electrolyte ions migrate through the carbon-containing stacked electrode according to the invention described above on account of the electrical potential drop. The current within the electrode should if possible be caused exclusively by electrons, not by ions. Depending on the given electrolysis conditions, in particular the electrolyte used, it may even be necessary to restrict or to suppress this migration of electrolyte ions through the carbon-containing stacked electrodes in order to achieve an appreciable electrolysis reaction on these stacked electrodes.

This can be achieved by surrounding the carbon-containing stacked electrode described above by a solid electrolyte. The solid electrolyte used can be fundamentally any material known for this function. Ion exchange membranes are preferably employed.

In this case, in addition to the solid electrolyte, a liquid electrolyte phase which contains the electrolysis starting materials is also used. This liquid phase preferably contains no free conductive ions or only small amounts thereof. An electronic current is thereby achieved exclusively or almost exclusively in the electrode. The ionic current between the electrodes is then completely or largely represented by ions which are bonded in the solid electrolyte, i.e. do not move through the carbon-containing stacked electrode freely on account of the potential drop.

Electrolyte liquids which are suitable for use in addition to solid electrolytes contain less than 10% by weight of conducting salts, preferably less than 3% by weight. Preferred solvents are organic substances such as methanol, ethanol, DMF, acetic acid, formic acid or acetonitrile.

The stacked electrodes can also be separated from one another by electrolyte-filled solids. An electrolyte-filled solid which can be used, in particular, is an electrolyte-filled web or gauze or a diaphragm.

The suppression of electrolyte ion migration according to the potential drop through the stacked electrode can in this case be hindered or suppressed by the carbon-containing stacked electrode described above comprising an additional layer hindering or preventing the migration of the electrolyte ions through this electrode according to the potential drop. This layer preferably consists of graphite board. However, metal foils can also be employed. These measures can be taken independently of the composition of the electrolyte, i.e. also additionally to a solid electrolyte.

However, it is also possible to design the pore size or permeability of the stacked electrode, e.g. by impregnation, such that the electrolyte ions, if possible, are not let through at all.

The stacked plate cells according to the invention offer an increased substance conversion and an improved selectivity.

In addition, these stacked cells take up only about 20% to 70% of the stacking space of conventional graphite stacked plate cells. The space saving is naturally also associated with a corresponding weight saving. In the cells according to the invention, the incident flow on the individual electrodes plays only a subordinate part. Expensive measures for improving the substance transport to the electrodes can thus also be dispensed with without the space-time yield being adversely affected to a measurable extent.

The stacked plate cells described can be employed according to the invention in electrolysis processes. An electrolysis process of this type is suitable, in particular, for the oxidation of aromatics such as substituted benzenes, substituted toluenes and substituted or unsubstituted naphthalenes. These substances are contained in the liquid electrolyte phase of the stacked plate cell.

Processes for the methoxylation of 4-methoxytoluene, p-xylene, p-tert-butyltoluene, 2-methyl-naphthalene, anisole or hydroquinone dimethyl ether are particularly preferred. These substances can also be acyloxylated using the process according to the invention.

Another preferred process relates to the anodic dimerization of substituted benzenes, substituted toluenes and substituted or unsubstituted naphthalenes, the substances mentioned preferably being substituted by $C_1$- to $C_5$-alkyl chains. Advantageously, the process according to the invention can also be employed for the methoxylation or hydroxylation of carbonyl compounds, in particular of cyclohexanone, acetone, butanone or substituted benzophenones.

Another preferred process according to the invention is the oxidation of alcohols or carbonyl compounds to carboxylic acids, e.g. of butynediol to acetylenedicarboxylic acid or of propargyl alcohol to propiolic acid.

The stacked plate cells according to the invention can advantageously also be used for the functionalization of amides, in particular of dimethylformamide to methoxymethyl-methylformamide.

The oxidation, reduction or functionalization of heterocycles using the process according to the invention described above is also advantageous. In this way, in particular, furan can be reacted to give dimethoxydihydrofuran or N-methylpyrrolid-2-one to give 5-methoxy-N-methylpyrrolid-2-one.

EXAMPLES

Example 1

Methoxylation of p-xylene p-Xylene was methoxylated in a stacked plate cell according to the invention. The electrolysis cell contained a stack of 6 annular disks of graphite felt type RVG 1000 from the company Deutsche Carbone having a thickness of 3 mm, an internal diameter of 30 mm and an external diameter of 140 mm. As a support for the electrolyte phase, annular disks of polypropylene filter gauzes having a thickness of 1.8 mm were mounted between the electrode plates. This cell was integrated in a recirculating apparatus in which the liquid electrolyte solution, consisting of a mixture of 450 g of p-xylene to be methoxylated, 30 g of sodium benzenesulfonate, and also 2520 g of methanol, was recirculated.

The electrolysis was carried out at a temperature from approximately 30° C. to 40° C., a voltage of 5 V to 6 V and a current strength of approximately 5 A until an amount of current measured by the hydrogen development on the cathode of 4.4 F per mole of p-xylene had been employed.

The substance conversion was 99% and the current yield 74% with a yield of 71% of tolylaldehyde dimethyl acetal and 24% of tolyl methyl ether.

Example 2

Electrolysis of Cyclohexanone

The plate stack consisted of 12 annular disks of graphite felt of the type RVG 2003 from the company Deutsche Carbone having a thickness of 3 mm, an internal diameter of 30 mm and an external diameter of 140 mm. Between the plates was in each case arranged a 2 mm thick layer of graphite board of the type Sigraflex from the company Sigri and a filter gauze of polypropylene. These intermediate layers were likewise constructed as annular disks.

The electrolyte consisted of 600 g of cyclohexanone to be electrolyzed, 2259 g of methanol, 66 g of water, 15 g of potassium iodide and 60 g of potassium hydroxide (43% strength).

The electrolysis temperature was from 15° C. to 20° C. and the current strength was approximately 5 A. The electrolysis was terminated after a charge transport of 2.2 F per mole of cyclohexanone.

A substance conversion of 97% was achieved. The yield of 1-hydroxycyclohexan-2-one dimethyl ketal was 71%. This product was obtained in pure form by distillation after distilling off the methanol and separating off the conductive salt. In this case, the iodine content of the ketal was less than 1 ppm.

Comparison Example to Example 2

For comparison, cyclohexanone was treated in a conventional electrolysis cell having a plate stack of 11 annular disks. The annular disks consisted of flat-ground solid graphite having an unevenness of less than 0.1 mm, and had a thickness of 5 mm, an internal diameter of 30 mm and an external diameter of 140 mm. The electrode disks were arranged in the cell at a distance of 0.5 mm from one another, the plate distance being maintained by radially arranged polypropylene strips which covered less than 10% of the electrode surface.

The liquid electrolyte solution consisted of a mixture of 675 g of cyclohexanone to be electrolyzed, 1965 g of methanol, 45 g of water, 2 g of $NaOCH_3$ and 90 g of potassium iodide.

The electrolysis was carried out at a temperature from approximately 30° C. to 40° C. and a current strength of approximately 5 A until an amount of current of 2.2 F per mole of cyclohexanone had been employed.

The substance conversion was 98% with a distinctly lower yield of 62% of 1-hydroxycyclohexan-2-one dimethyl ketal. After distilling off methanol and separating off the conductive salt, an iodine content of approximately 30 ppm is obtained in the distilled goods.

The electrolysis cell according to the invention thus allows distinctly increased yields together with comparable energy use with, at the same time, lower use of potassium iodide, which can be replaced to a considerable extent by the more favorable potassium hydroxide. This in turn leads to a purer electrolysis product.

Example 3

Methoxyation of p-xylene

Construction and the carrying-out of the experiments corresponded to Example 1. Instead of pure graphite felt electrodes, however, electrodes were used which were composed of a layer of graphite felt of the type Sigratherm GDF 5 from the company Sigri connected as the anode and of a layer of RA2 foil connected as the cathode.

The electrolysis was carried out at from 48° C. to 55° C. and at a current strength of approximately 5 A. It was terminated at a charge transport of 7.5 F per mole of p-xylene. In this case, a yield of 86% of tolylaldehyde dimethyl acetal was achieved with a substance conversion of 99%.

Comparison Example to Example 3

Instead of the electrodes described above in Example 3, solid graphite plate electrodes were used such as were described above in the comparison example to Example 2. The electrolysis conditions corresponded to those described in Example 3.

At a substance conversion of 99%, the yield of tolylaldehyde dimethyl acetal was 77%. Even the modified electrode arrangement according to the invention thus offers considerable advantages in the space-time yield of the electrolysis process.

Example 4

Methoxylation of Dimethyformamide (DMF)

In this electrolysis cell according to the invention, the plate stack consisted of an alternating sequence of 9 annular disks of the type RVG 1000 from the company Deutsche Carbone and 8 annular disks of the type Nafion 117 from the company Dupont, which were arranged as described in Example 1. The Nafion 117 was swollen in DMF at 110° C. for 10 min beforehand.

The electrolyte liquid initially introduced into the apparatus contained 584 g of DMF and 2560 g of methanol. The electrolysis temperature was from 40° C. to 47° C., and the cell voltage was from 5 V to 6 V and the current strength from 3 A to 5 A.

A conversion of DMF of approximately 90% was achieved. After the removal of methanol on a rotary evaporator, a (di)methoxy-DMF yield of approximately 70% was achieved. The selectivity was around 70%; it was possible to achieve selectivities of almost 90% with only a slightly decreased conversion.

In the continuous experiment, after a running time of 390 hours at an average current use of 1.66 F per mole of DMF an average selectivity of 79% was achieved. The average current yield was just under 90% based on the DMF consumption.

Comparison Example to Example 4

A conventional electrolys is cell was used, such as is described in the dissertation by R. Grege, Dortmund, 1990, pages 8 to 10. The intermediate layer used between the electrodes was Nafion 117, which was swollen in DMF at 110° C. for 10 min beforehand.

The electrolysis temperature was 80° C. The current yield was 95% and the conversion of dimethyl-formamide only 10%.

An additional advantage of the cell according to the invention compared with the conventional cell described by way of example by Grege results from the simpler assembly and arrangement of the plate stack. Equipment for holding and adjusting the graphite plates is completely unnecessary here, as the felt plates are simply stacked alternately with solid electrolytes. The stacked plate cell according to the invention is thus not only lighter and smaller, but also significantly more easily constructed.

We claim:

1. A stacked plate cell comprising a plurality of serially connected stacked electrodes comprising at least one carbon-containing stacked electrode comprising a graphite felt plate, a carbon felt plate, a web having a carbon-covered starting material contact surface or a porous solid having a carbon-covered starting material contact surface, a liquid electrolyte phase, and a barrier to hinder or prevent migration of electrolyte ions on account of the electrical potential drop through the carbon-containing stacked electrode.

2. A stacked plate cell as claimed in claim 1, wherein the barrier comprises a solid electrolyte touching the carbon-containing stacked electrode.

3. A stacked plate cell as claimed in claim 2, wherein the solid electrolyte is an ion exchange membrane.

4. A stacked plate cell as claimed in claim 1, wherein the liquid electrolyte phase contains no free conductive ions or only small amounts of free conductive ions.

5. A stacked plate cell as claimed in claim 1, wherein at least two stacked electrodes are separated by an electrolyte-filed solid.

6. A stacked plate cell as claimed in claim 5, wherein the electrolyte-filed solid is an electrolyte-filled web or gauze or a diaphragm.

7. A stacked plate cell as claimed in claim 1, wherein the carbon-containing stacked electrode comprises a layer hindering or preventing the migration of the electrolyte ions vertically through this stacked electrode.

8. A stacked plate cell as claimed in claim 7, wherein the layer hindering or preventing the migration of the electrolyte ions is made of graphite board.

9. A stacked plate cell as claimed in claim 1, wherein the carbon-containing stacked electrode itself serves as the barrier.

10. An electrolysis process, comprising passing an electric current through a stacked plate cell comprising a plurality of serially connected stacked electrodes comprising at least one carbon-containing stacked electrode comprising a graphite felt plate, a carbon felt plate, a web having a carbon-covered starting material contact surface or a porous solid having a carbon-covered starting material contact surface, and a liquid electrolyte phase, and hindering or preventing migration of electrolyte ions on account of the electrical potential drop through the carbon-containing stacked electrode.

11. A process as claimed in claim 10, wherein the liquid electrolyte phase in the stacked plate cell comprises aromatic compounds, in particular substituted benzenes, substituted toluenes or substituted or unsubstituted naphthalenes, and these are oxidized.

12. A process as claimed in claim 10, wherein the liquid electrolyte phase in the stacked plate cell comprises 4-methoxytoluene, p-xylene, p-tert-butyltoluene, 2-methylnaphthalene, anisole or hydroquinone dimethyl ether and these are alkoxylated or acyloxylated.

13. A process as claimed in claim 10, wherein the liquid electrolyte phase in the stacked plate cell comprises substituted benzenes, substituted toluenes or substituted or unsubstituted naphthalenes and these are anodically dimerized, the aromatics preferably being $C_1$- to $C_5$-alkyl-substituted.

14. A process as claimed in claim 10, wherein the liquid electrolyte phase in the stacked plate cell comprises carbonyl compounds, in particular cyclohexanone, acetone, butanone or substituted benzophenones, and these are methoxylated or hydroxylated.

15. A process as claimed in claim 10, wherein the liquid electrolyte phase in the stacked plate cell comprises alcohols or carbonyl compounds and these are oxidized to carboxylic acids, e.g. butynediol to acetylenedicarboxylic acid or propargyl alcohol to propiolic acid.

16. A process as claimed in claim 10, wherein the liquid electrolyte phase in the stacked plate cell comprises amides and these are functionalized, dimethylformamide, in particular, being functionalized to methoxymethylmethylformamide.

17. A process as claimed in claim 10, wherein the liquid electrolyte phase in the stacked plate cell comprises heterocycles and these are oxidized, reduced or functionalized, furan, in particular, being converted to dimethoxydihydrofuran or N-methylpyrrolid-2-one to 5-methoxy-N-methylpyrrolid-2-one.

* * * * *